United States Patent [19]

Kwait

[11] 4,060,374

[45] Nov. 29, 1977

[54] FUEL SAVING SYSTEM

[76] Inventor: Benjamin F. Kwait, 100 Old Cow Pasture Lane, Smoke Rise, Kinnelon, N.J. 07405

[21] Appl. No.: 693,760

[22] Filed: June 8, 1976

[51] Int. Cl.[2] ..... F23C 7/02

[52] U.S. Cl. ..... 431/190

[58] Field of Search ..... 431/190, 164, 165, 10, 431/187, 188, 351

[56] References Cited

U.S. PATENT DOCUMENTS

| | | | |
|---|---|---|---|
| 3,174,530 | 3/1965 | Meenan | 431/190 |
| 3,291,182 | 12/1966 | Dow, Jr. et al. | 431/190 X |
| 3,909,185 | 9/1975 | Vits | 431/190 |
| 3,955,909 | 5/1976 | Craig et al. | 431/10 |

*Primary Examiner*—Edward G. Favors
*Attorney, Agent, or Firm*—Allison C. Collard

[57] ABSTRACT

This invention pertains to a fuel saving system capable of use in connection with boilers and furnaces of various types employed in a large variety of commercial, industrial and domestic equipments. According to the invention, a plurality of tubes is located around the burner of the boiler in such a manner that air projected from the tubes arrives at the heart of the full flame. Air is projected into the tubes from a blower connected with a wind box of a separate blower which is connected with a regulatable damper and a duct. Lower tubes supply superheated air to the bottom of the flame in the combustion chamber creating a turbulent premixed flame.

1 Claim, 5 Drawing Figures

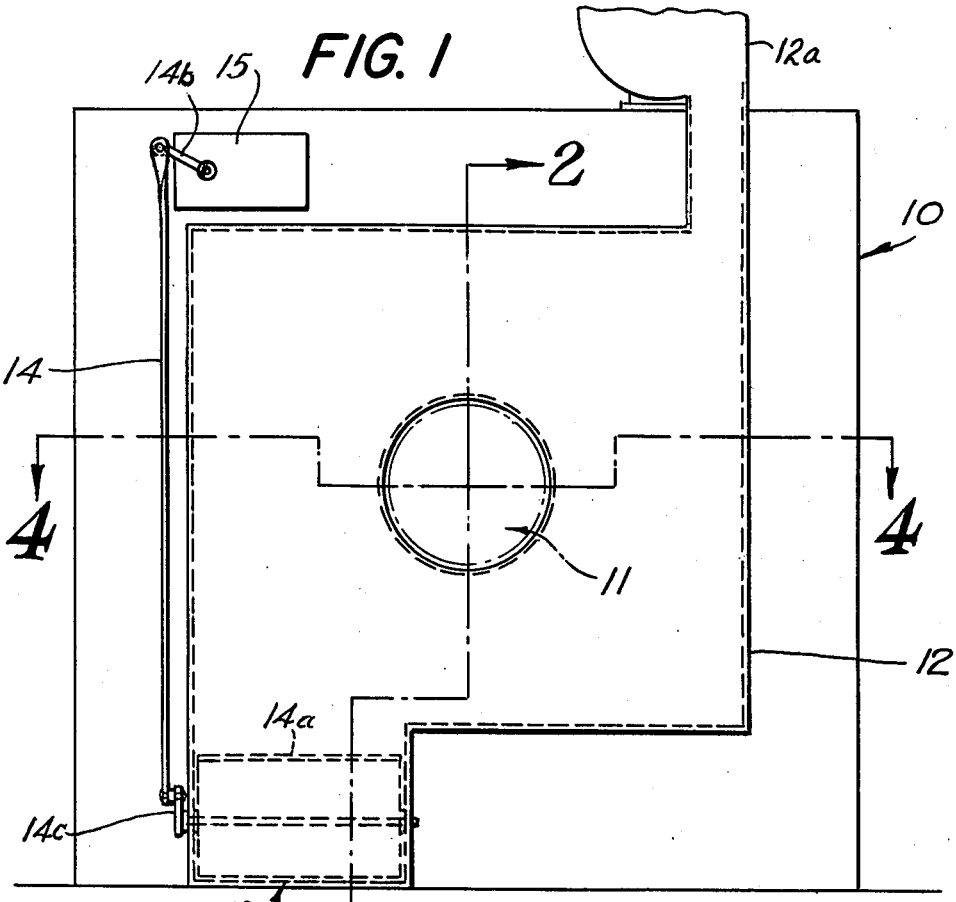
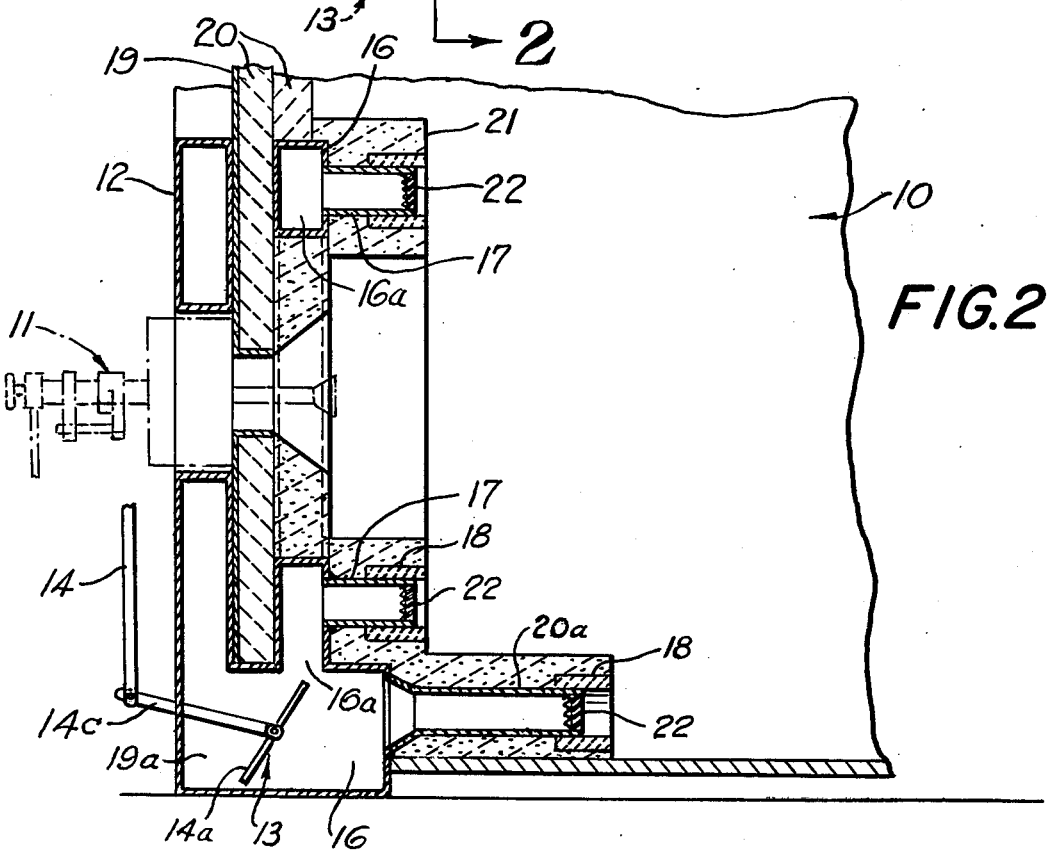
FIG. 2

FUEL SAVING SYSTEM

This invention relates to a fuel saving system for use with a variety of boilers employed in various industrial, commerical and domestic boilers and furnaces.

An object of the present invention is to provide a system of this type which will result in economy of fuel used in boilers and furnaces and which will provide a more complete combustion of the fuel while greatly reducing soot.

Other objects of the present invention will become apparent in the course of the following specification.

In the accomplishment of the objectives of the present invention it was found desirable to provide a plurality of inner tubes located around the burner of the boiler in such a manner that superheated air projected from the tubes arrives at the heart of the flame in the boiler. Air is projected into the tubes by a device which includes a blower which can be mounted on top of the burner and connected with a wind box extending to the bottom of the burner. A blower without a wind box can also be mounted where convenient on the boiler. A damper is connected to the bottom of the wind box and is also connected with a duct supplying air to the tubes. There are also other bottom tubes which receive superheated air, which mix with the bottom flame creating turbulance resulting in a premixed flame. The damper can be regulated by a modulator operated from a box carried by the boiler.

The invention will appear more clearly from the following detailed description when taken in connection with the accompanying drawings showing by way of example only, a preferred embodiment of the inventive idea.

In the drawings:

FIG. 1 is a front view of a boiler having the system of the present invention.

FIG. 2 is a cross-section along the line 2—2 of FIG. 1.

Figure 3:
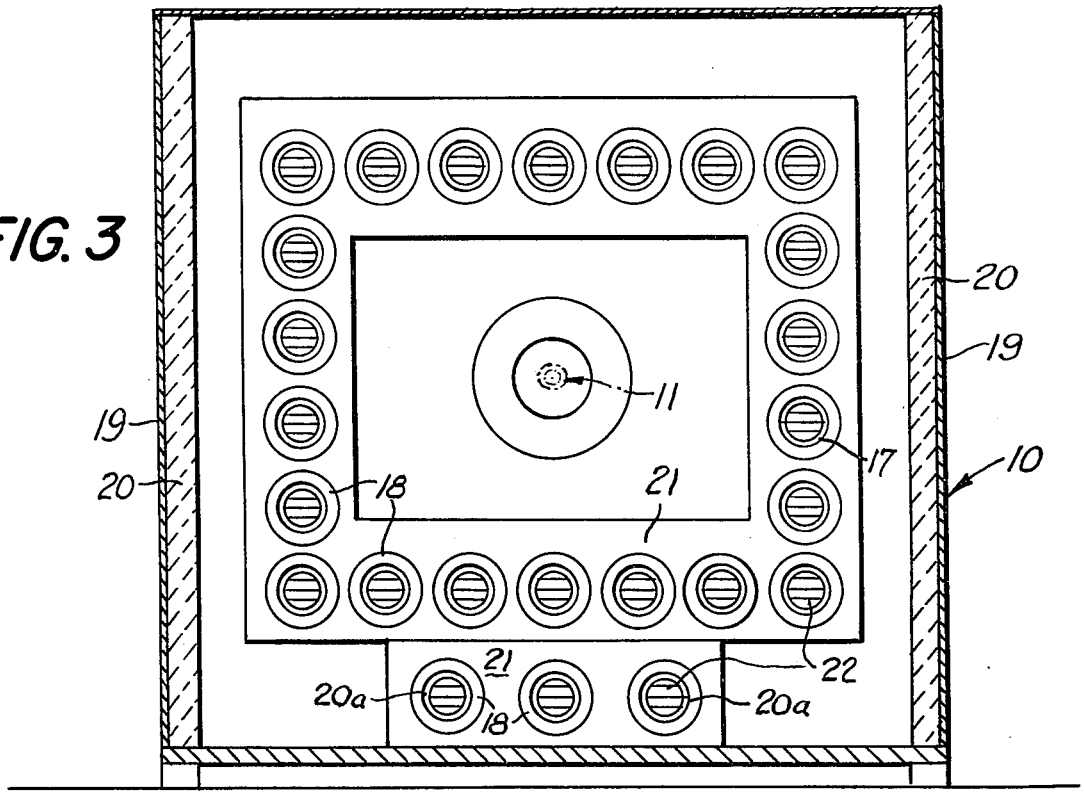
FIG. 3 shows the interior of the boiler and is a sectional view facing the burner opening with the tubes.
Figure 4:
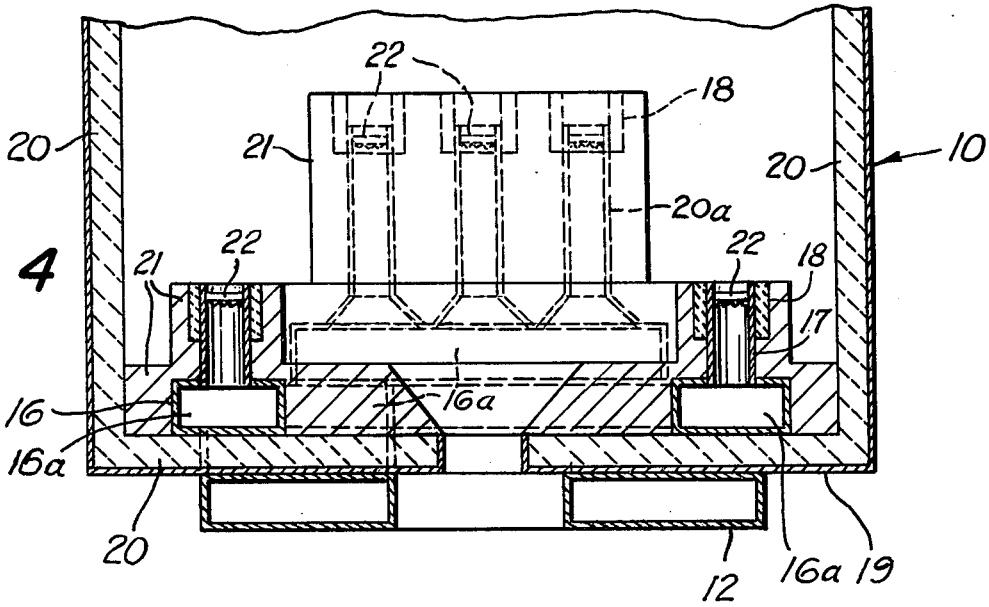
FIG. 4 is a cross-section along the line 4—4 of FIG. 1.
Figure 5:
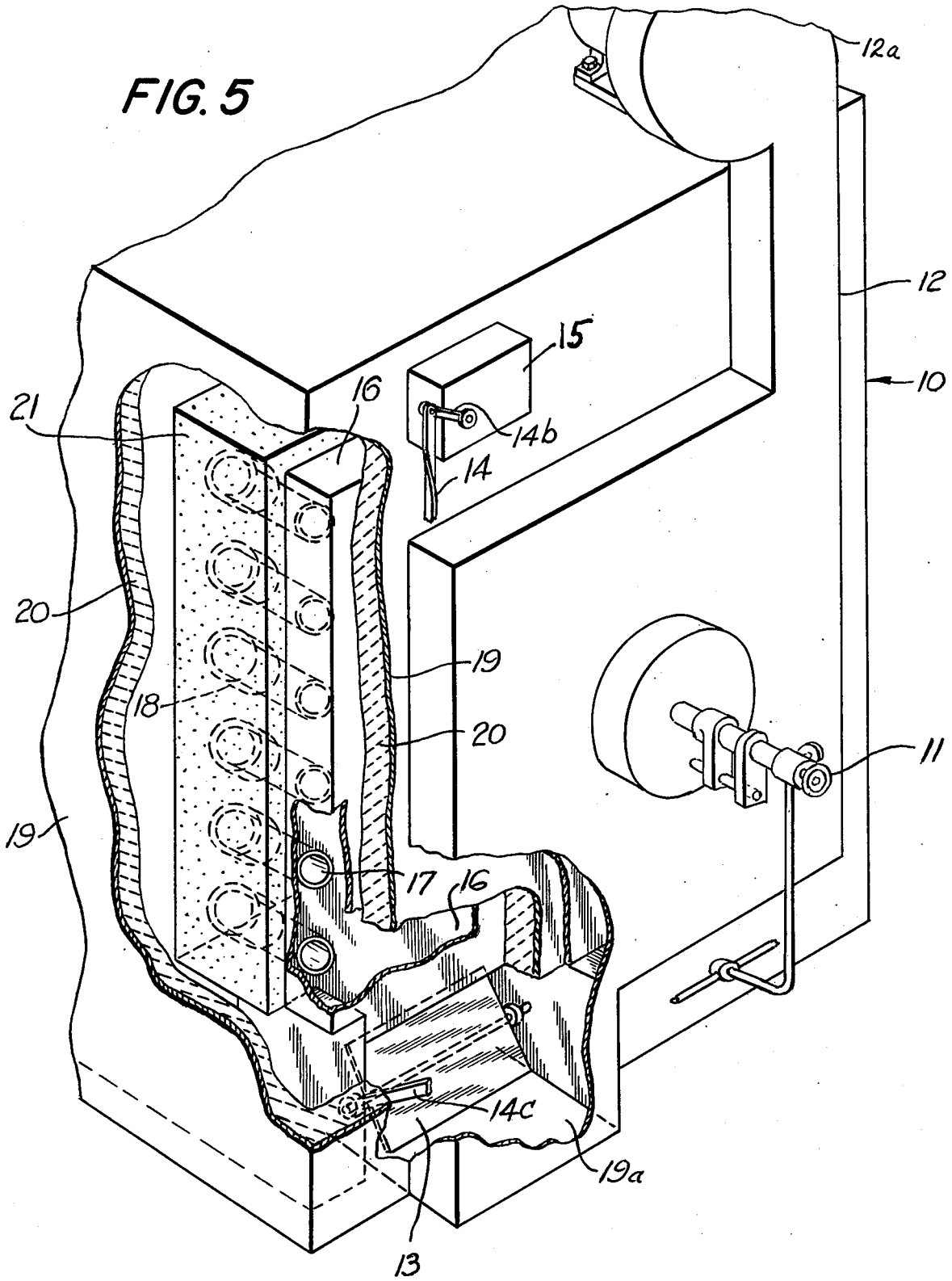
FIG. 5 is a perspective view of the boiler partly in section.

The drawings show a boiler 10 having a burner 11 and connected with a wind box 12 carrying a blower **12*a*. The boiler 10 has steel walls 19 with inner fire bricks 20**.

In accordance with the present invention a chamber is provided through the wall of the boiler to receive a damper 13. The damper 13 receives air blown by the blower **12*a* through the wind box 12 connected by a lower passage 19*a* with the damper. Inside the damper there is a swinging plate 14*a* constituting a part of a modulator 15. The modulator 15 is mounted in a box carried upon an outer surface of the boiler close to the top thereof. It is operated by a linkage which includes a lever 14*b* connected with a long vertically extending rod 14. The lower end of the rod 14 is operatively connected with the swinging plate 14*a* by a link 14*c***.

An important feature of the present invention is the provision of a so-called plenum 16 which is located inside the boiler around the burner 11, The plenum includes a metal duct **16*a* which communicates with the damper 13 and which carries a series of welded tubes 17 equally spaced on its four sides. A plurality of tubes 20*a* are also provided close to the bottom of the boiler. All these tubes may be designated as fuel saving units. Tubular refractory shields 18 are located in front of the tubes which extend outwardly into the boiler. A casing 21 consisting of plastic refractory material encases the tubes and is located inside the boiler. The tubes also carry steel louvres and screens 22**.

The boiler of the present invention is operated as follows:

Air is forced by the blower **12*a* through the wind box 12 and into the bottom damper 13. Air coming out of the damper and through the duct 16*a* becomes superheated air. The superheated air flows through the duct and out of the series of tubes 17 and 20*a* extending around the burner 11** and under the burner into the flame creating turbulance and premixed flame.

The tubes 17 are actually arranged in a perimeter around the flame of the burner so that air projected from the tubes arrives at the heart and in the center of the boiler.

The damper 13 can be opened or closed depending on demand by operating the modulator 15 which is linked to the damper. The steam demand is regulated in this manner.

It is apparent that the described construction is most effective in providing fuel economy, a more complete combustion which reduces smoke, soot and unburned combustibles to provide fuel savings.

It is also apparent that various changes may be made in the described construction within the scope of the appended claim.

I claim:

1. A boiler comprising:

a boiler including an elongated, tubular combustion chamber having a front wall and a rear wall;

a burner mounted on said front wall of said combustion chamber and disposed to direct the flame emitted therefrom, toward said rear wall of said combustion chamber;

a first plurality of spaced-apart, air-feeding tubes, each having an inlet and outlet opening, encased in a refractory material and mounted on said front wall of said chamber and spaced about the periphery of said burner, so as to direct the air flowing from the outlet openings thereof into the heart of the flame emitted by said burner and into the center of said combustion chamber;

a second plurality of spaced-apart, air-feeding tubes, each having an inlet and outlet opening, encased in a refractory material and mounted on said front wall of said chamber and disposed beneath said burner and said first plurality, for directing the air flowing from the outlet openings thereof into the bottom portion of the flame emitted by said burner, so as to create turbulence therein;

a plurality of tubular refractory shields, each of which encases one of said air-feeding tubes adjacent the outlet opening thereof, and a plurality of louvered baffles, each of which covers the outlet opening of one of said air-feeding tubes, said refractory shields, louvered baffles, and refractory encasement of said tubes cooperating to superheat the air flowing through said tubes, prior to injection into said combustion chamber; and means for supplying air under pressure to said inlet openings of said tubes, said means including a blower carried by said boiler, a windbox having an end connected with said blower, a damper connected with the other end of said windbox, and a metal duct connecting said damper with said inlet openings of said tubes, and a modulator carried by said boiler and operatively connected with said damper for regulating the flow of air therethrough.

* * * * *